US007699462B2

(12) United States Patent
Godoy

(10) Patent No.: US 7,699,462 B2
(45) Date of Patent: Apr. 20, 2010

(54) SCUBA DIVING MASK WITH CORRECTIVE LENSES

(75) Inventor: Carlos Alberto Godoy, Genoa (IT)

(73) Assignee: Cressi-Sub S.p.A., Genoa (IT)

( * ) Notice: Subject to any disclaimer, the term of this patent is extended or adjusted under 35 U.S.C. 154(b) by 30 days.

(21) Appl. No.: 11/901,425

(22) Filed: Sep. 16, 2007

(65) Prior Publication Data

US 2008/0074607 A1 Mar. 27, 2008

(30) Foreign Application Priority Data

Sep. 15, 2006 (IT) ..... FI20060058 U

(51) Int. Cl.
*G02C 1/00* (2006.01)
*A61F 9/02* (2006.01)

(52) U.S. Cl. ..... 351/43; 351/41; 2/441

(58) Field of Classification Search ..... 351/43, 351/41, 158; 2/428, 410, 422, 424, 425, 2/426, 430–435, 441

See application file for complete search history.

(56) References Cited

U.S. PATENT DOCUMENTS 6,092,895 A * 7/2000 Sato et al. ..... 351/43
6,349,420 B1 * 2/2002 Chiang ..... 2/428

* cited by examiner

*Primary Examiner*—Hung X Dang
(74) *Attorney, Agent, or Firm*—Pollack, P.C.

(57) ABSTRACT

A scuba diving mask with corrective lenses comprising a frame with a plurality of rings joined to one another by a bridge, each of the rings having an internal flange on which the lip of a flexible skirt, a corresponding lens and a lens-retaining collar rest. The collar is attached by snap action to the corresponding ring. A seat is formed in a bridge substantially in the lying plane of, or coplanar with, the lenses and extending laterally to an upper internal portion of the rings. The seat includes a locking plate slidable between opposing end stroke positions - a locking end position and a release end positions respectively. When the locking plate is in the locking position, the lateral sides of the plate extend inside the rings and are engaged with corresponding notches in an upper internal rim of the lens-retaining collars.

9 Claims, 8 Drawing Sheets

SCUBA DIVING MASK WITH CORRECTIVE LENSES

FIELD OF THE INVENTION

The present invention relates generally to aquatic activities and, more particularly, to equipment for use in limited oxygen environments or the like.

BACKGROUND OF THE INVENTION

Conventional scuba diving masks, for example, can often be retrofitted with corrective lenses to accommodate scuba divers who may need to compensate for their poor eyesight during underwater activities.

Such masks typically have a frame with two relatively rigid rings, circular or non-circular rings joined to one another by a bridge configured for positioning over a user's nose. The internal contour of each ring is provided with flanges for engaging "visors", i.e., transparent lenses that allow the user to see underwater. The visors are held in position by retaining collars that replicate the internal contour of the rings and may be attached to the frame, either removably or permanently, using suitable fasteners.

In other scuba diving masks suitable for fitting with corrective lenses, the same lens can generally be mounted on both the right side and left side of the mask, by simply rotating the lens about an axis perpendicular to the plane of the lens. Generally speaking, the lenses are symmetrical to avoid obliging retailers to keep double sets of right-hand and left-hand lenses. As a result, manufacturers usually provide retailers with the operative components of each diving mask separately, that is, they supply the diving masks without lenses together with a set of corrective lenses, so that the retailers can later select the appropriate combination of lenses for the masks to suit a particular customer's requirements, e.g., eyeglass precription. Alternatively, this type of mask can be fitted with ordinary lenses, as is appreciated by those skilled in the art.

The assembly or replacement of lenses by the retailer, however, requires suitable equipment, which generally comprises a dedicated tool—a basic screwdriver, in many cases—by which the retaining collars are separated from the mask frame in order to install or replace a lens. Typically, the retailer is instructed suitably to perform these operations without damage to lenses e.g., scratching, or to the mask frame. However, as the dedicated tool is generally harder than the lens or the frame, and because personnel performing the installation are not always adequately trained or sufficiently experienced, there is still significant risk of mask damage.

Moreover, when lenses are installed or replaced by the end user, without the use of a dedicated tool and/or the necessary experience, there is a significantly greater risk of damaging the lenses or frame. Indeed, the action of replacing a lens, and even more of installing a lens, carries an additional risk of damage to the lip of the skirt located between the frame and the lens, with the resulting loss of watertightness of the mask. This problem has also been experienced where a mask is equipped with ordinary lenses and replacement of a damaged "visor "is desired.

OBJECTS AND SUMMARY OF THE INVENTION

Accordingly, it is an object of the present invention to provide a scuba diving mask for selectively mounting corrective lenses that not only does not require a special or dedicated tool for installation and replacement of lenses, but also enables installation and replacement to be done easily by any user, thereby eliminating any risk of damage to the mask frame, lenses or skirt, and associated loss of watertightness of the mask.

In accordance with one aspect of the present invention, there is provided a scuba diving mask with corrective lenses. The mask includes a bridge with a seat arranged substantially in the lying plane of, or coplanar with, the lenses and extending laterally to an upper internal portion of the rings. A locking plate is engaged or housed slidingly in the seat such that it may translate between opposing end stroke positions, i.e., a locking end position and a release end position, respectively. When the locking plate is in the locking position, the lateral sides of the plate extend inside the rings, and are engaged in corresponding notches in an upper internal rim of the lens-retaining collars. In this manner, the collars are locked against the rings, thereby stabilizing the structure of the mask, such that it may only be disassembled by sliding the plate relative to the bridge using a selected tool.

According to another aspect of the present invention, there is provided a scuba diving mask with corrective lenses. The mask comprises a frame having a plurality of rings joined to one another by a bridge. Each ring has an internal flange on which there rests a lip of a flexible skirt, a corresponding lens, and a lens-retaining collar, the collar being mounted to the corresponding ring by snap engagement. A seat is formed in the bridge substantially coplanar with the lenses and extending laterally to an upper internal portion of the rings. The seat includes a locking plate slidable between respective opposing end stroke positions, namely, a locking end position and a release end position. When the plate is in the locking end position, the lateral sides of the plate extend inside the rings, and engage corresponding notches in an upper internal rim of the lens-retaining collars.

BRIEF DESCRIPTION OF THE DRAWINGS

A specific, illustrative scuba diving mask with corrective lenses, according to the present invention, is described below with reference to the accompanying drawings, in which:

FIGS. 1-1*d* are sectional views of the mask shown in FIG. 1 taken along lines 1*a*-1*a*, 1*b*-1*b*, 1*c*-1*c* and 1*d*-1*d*, respectively;

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 1:
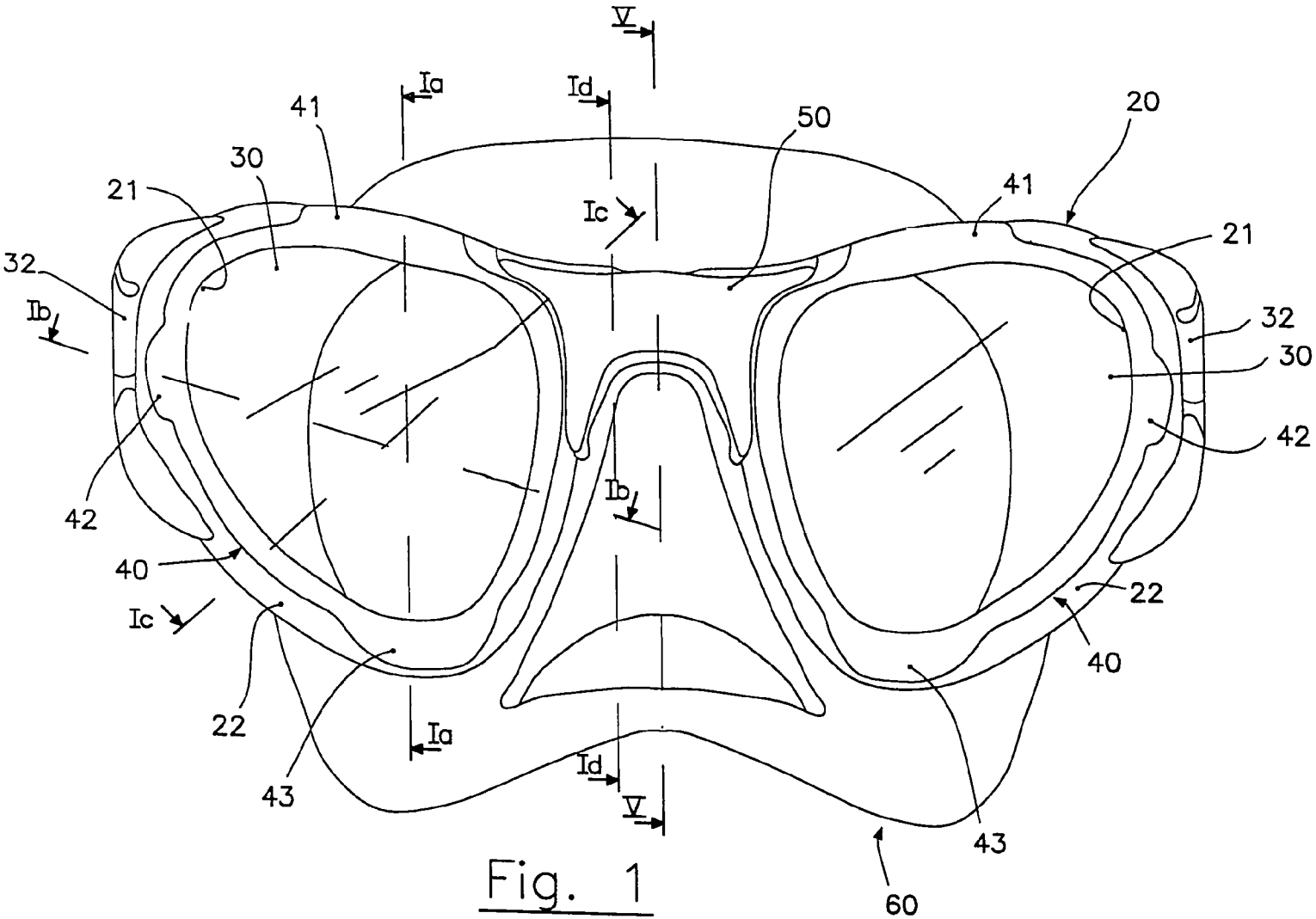
FIG. 1 is a front view of a scuba diving mask, according to one aspect of the present invention, having corrective lenses, corresponding lens-retaining collars, and a device for locking the collars in place.

Referring now to the drawings and, more particularly, to FIGS. 1-7, there is shown generally a specific, illustrative mask with corrective lenses, according to various aspects of the present invention. In one embodiment, illustrated generally in FIG. 1, the mask comprises a frame 20 having a plurality of generally symmetrical rings 22, e.g., two, surrounding a corresponding number, e.g., two, of relatively symmetrical openings 21. The rings desirably have a substantially L-shaped cross-section and comprise an internal flange 23 and an internal cylindrical surface 24 for positioning a lens 30 that, after insertion of a lip 61 of a skirt 60, is locked against the internal flange by a collar 40, shown in detail in FIGS. 3-4. Preferably, two brackets 32 extend laterally from rings 22. A strap is adjustably attached to the brackets in a conventional manner such as using buckles (not shown).

Figure 2:
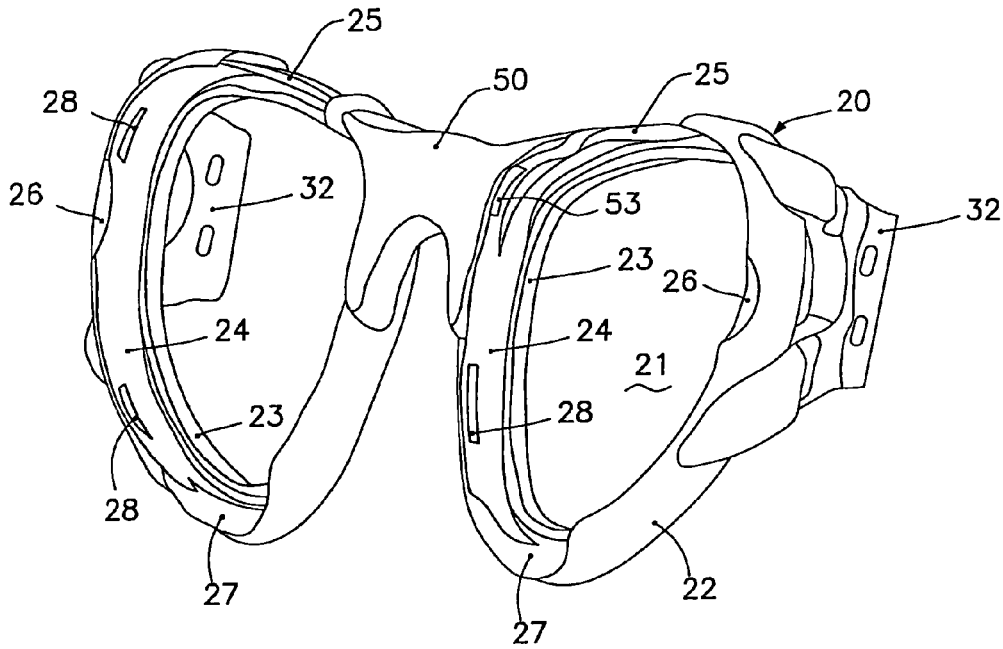
FIG. 2 is a perspective view of the mask frame shown in FIG. 1 without the lenses, lens-retaining collars and skirt.

According to one aspect of the present invention, in order to properly position each collar 40, namely, inside opening 21 of corresponding ring 22, and about an axis substantially perpendicular to the plane in which the collar lies, the collar is provided with a series of flanges that surround the outside of at least a portion of the ring, that is, an upper flange 41, a lateral flange 42 and a lower flange 43. Preferably, as shown in FIG. 2, flanges 41, 42 and 43 engage corresponding housing 25, 26 and 27 in an outer contour of ring 22.

Figure 1A:
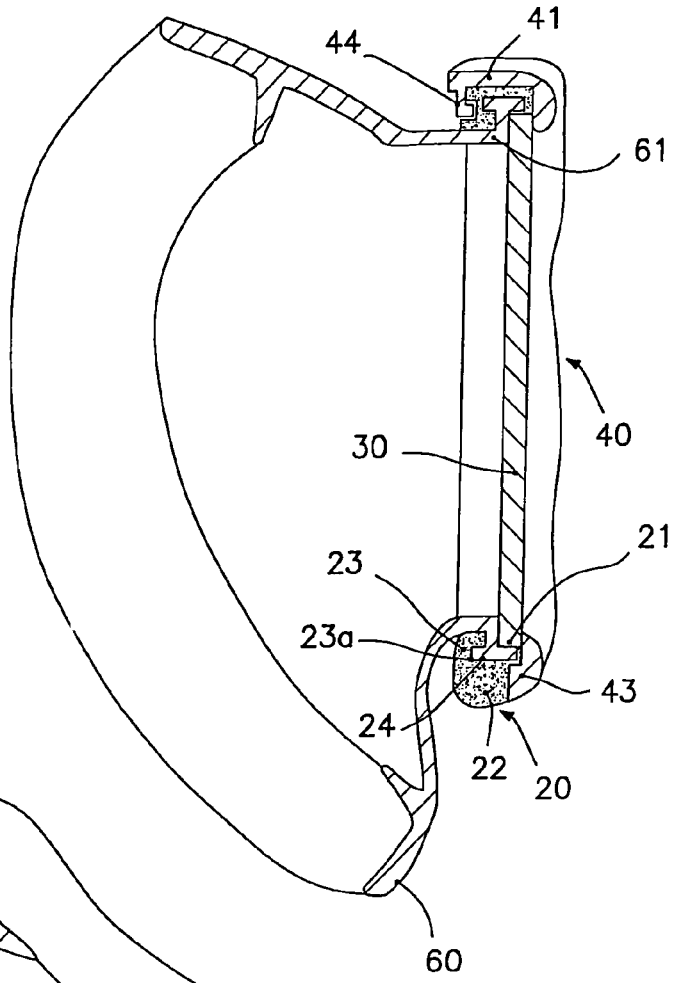
Figure 1B:
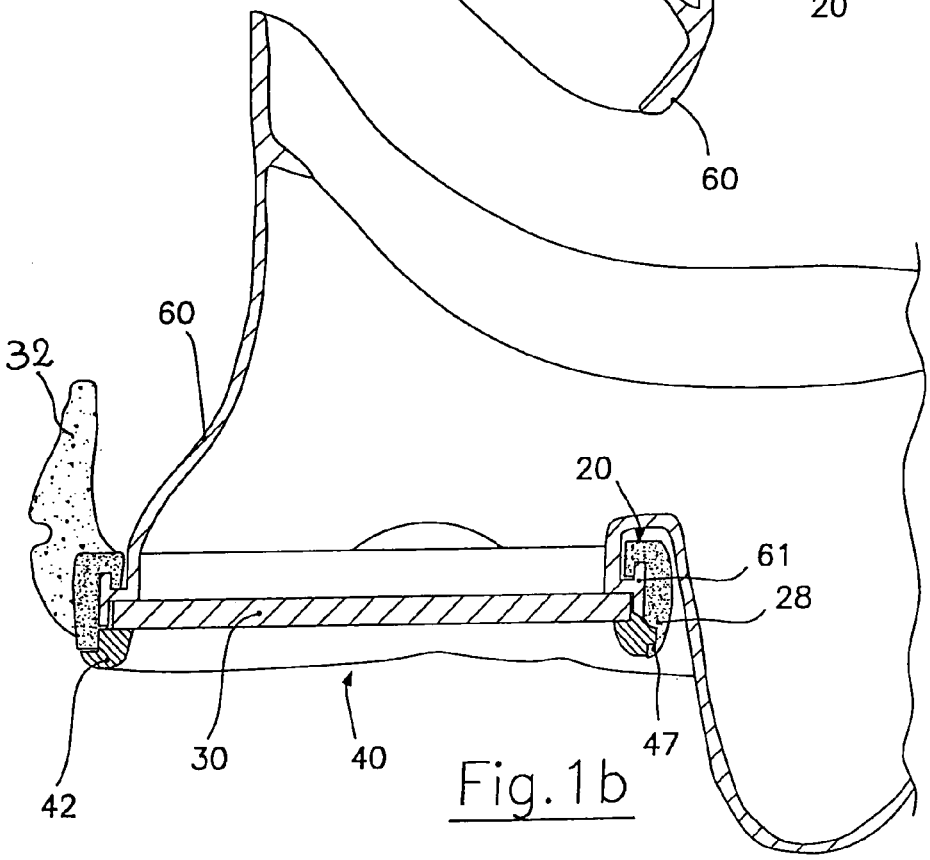
Figure 1C:
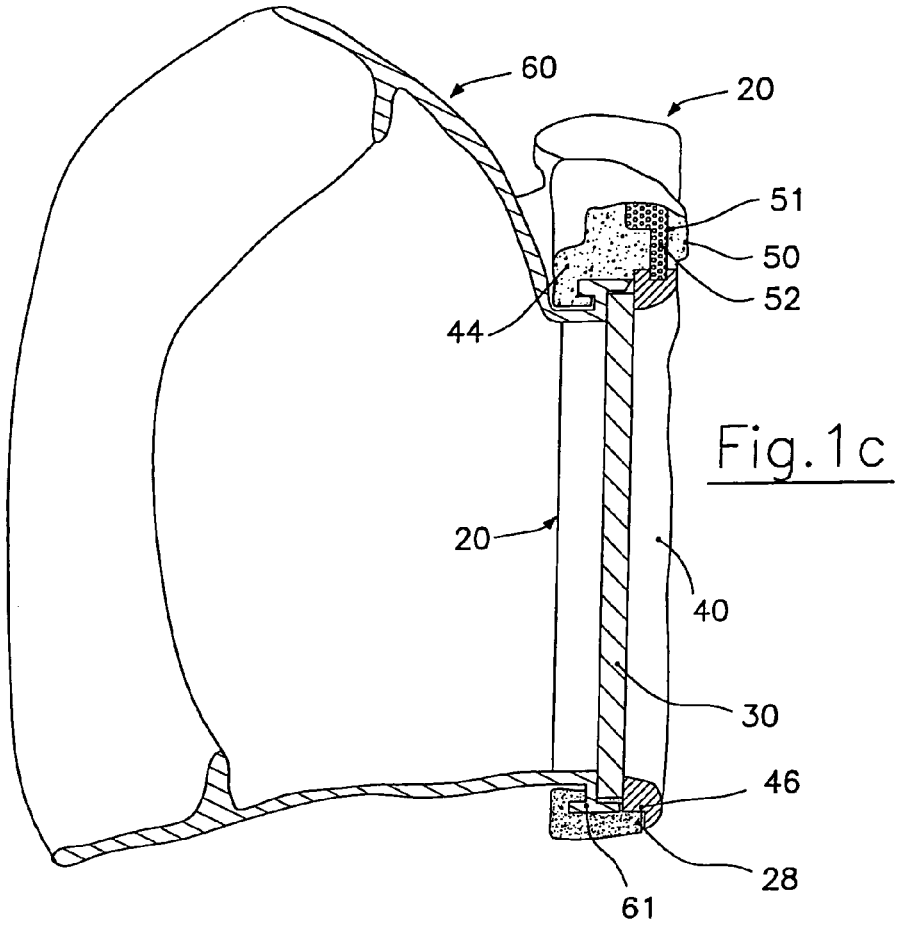
Figure 2A:
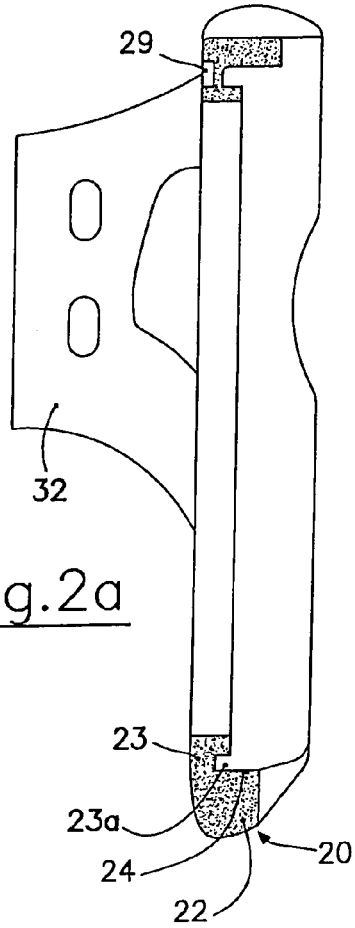
FIGS. 2*a*-2*c* are sectional views of the mask illustrated in FIGS. 1*a*-1*d* showing the mask frame only.
Figure 2C:
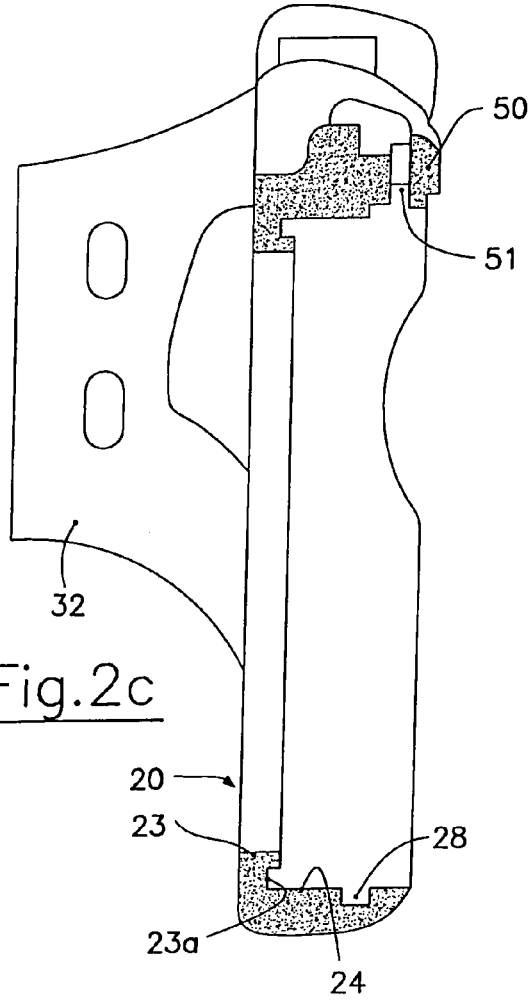
Figure 2B:
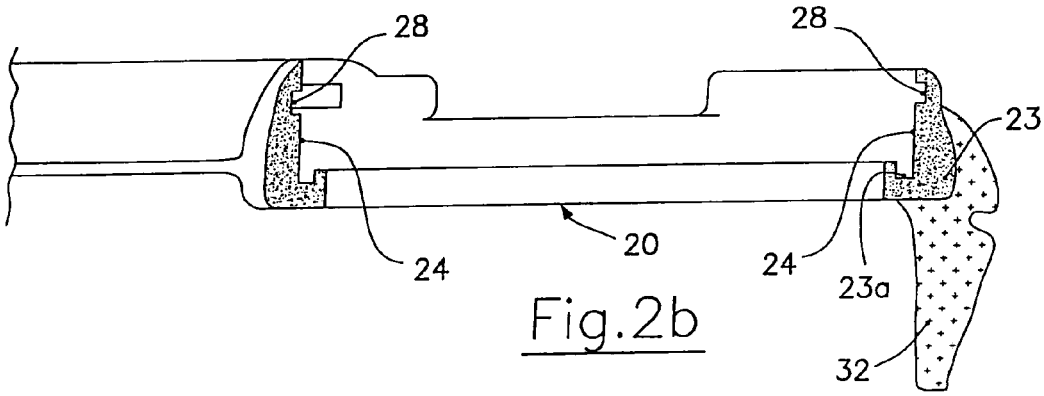

Alternatively or concurrently, for the proper positioning of the collar axially, upper flange 41 includes a tooth 44 for hooking a back portion of the ring. In addition, a rib 48 extends from the tooth and engages a groove 29, also provided on the back portion of the ring (See, for instances, FIGS. 1*a*, 2*a* and 3*a*). Furthermore, as best seen in FIGS. 3 and 4, each collar has teeth 45, 46 and 47 on its outer lateral surface, for engaging corresponding recesses 28 (See FIG. 2) in cylindrical internal surface 24 of rings 22 (as illustrated, for example, in FIG. 1*c*).

The flexibility of flanges 41, 42 and 43—associated with the intrinsic flexibility of collars 40 and rings 22 of frame 20—enables snap attachment of the collars to the respective rings, once lip 61 of skirt 60 and corrective lens 30 have been inserted in openings 21. Generally speaking, because flexibility inherent in these elements, could lead to unwanted detachment of collar 40 from corresponding ring 22, for instance, such as upon impact, a locking plate 52 is provided.

More specifically, according to one aspect of the present invention, as shown in FIGS. 1*c*, 2*c*, 3*c* and 5-7, to overcome this potential drawback, bridge 50, which joins symmetrical rings 22 to one another, is provided with a seat or slot 51 lying, for example, substantially parallel to the lying plane of the lenses or coplanar therewith. Locking plate 52 is slidingly engaged in and with the slot and movable between opposing end stroke positions, namely, a first or upper end position at which the locking plate extends partially from the bridge, and a second or lower end position where the plate extends laterally into surface 24 of the rings through slits 53, as are visible generally in FIG. 2.

Figure 3:
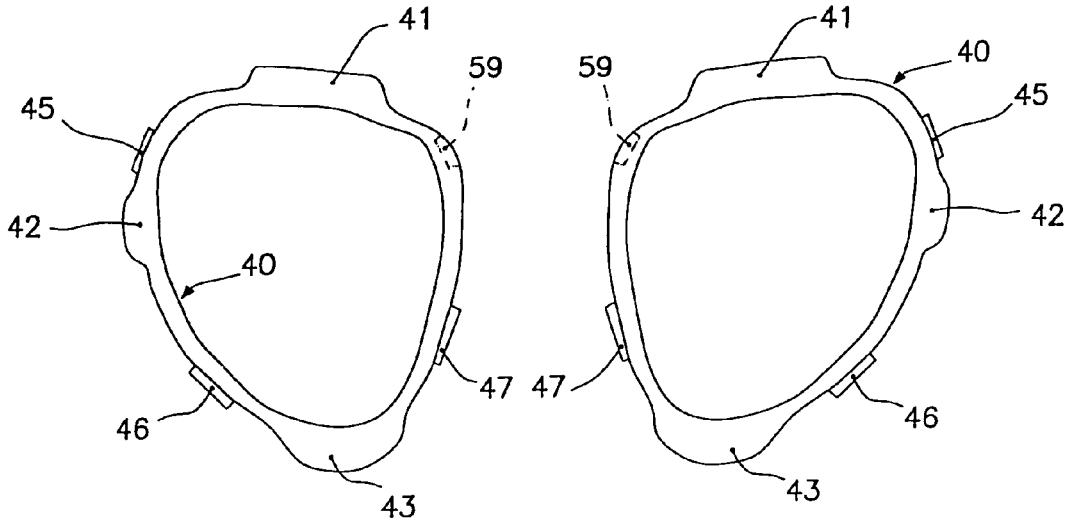
FIG. 3 is a front view of the lens-retaining collars set forth in FIG. 1, upon installation to the mask frame.
Figure 3A:
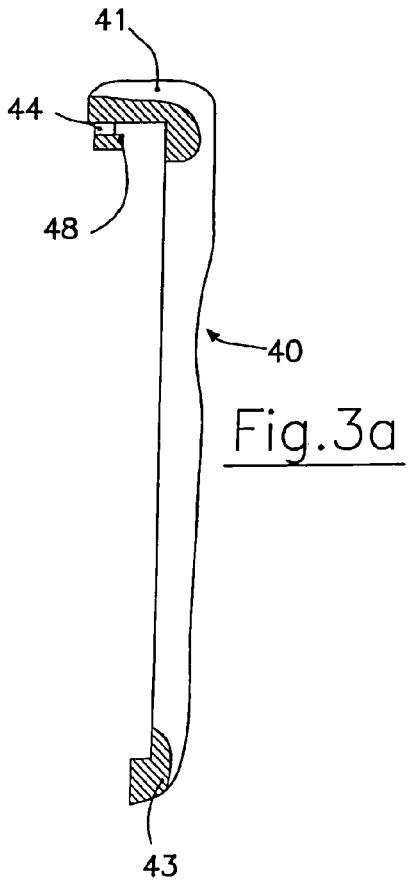
FIGS. 3*a*-3*c* are sectional views of the lens-retaining collars illustrated in FIGS. 1*a*-1*d*, showing the lens-retaining collar only.
Figure 3C:
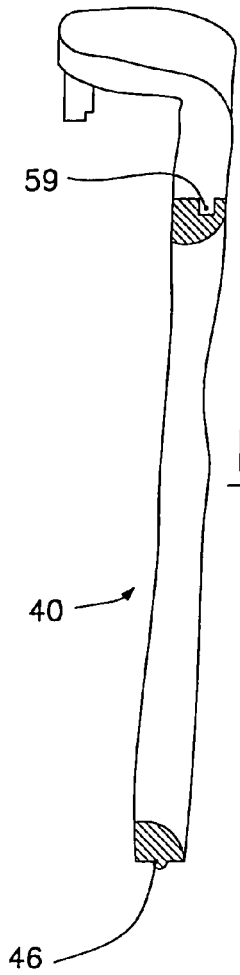
Figure 3B:
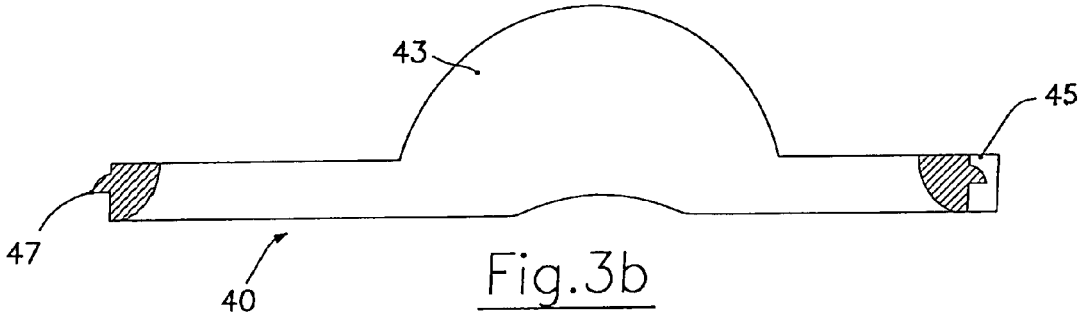
Figure 4:
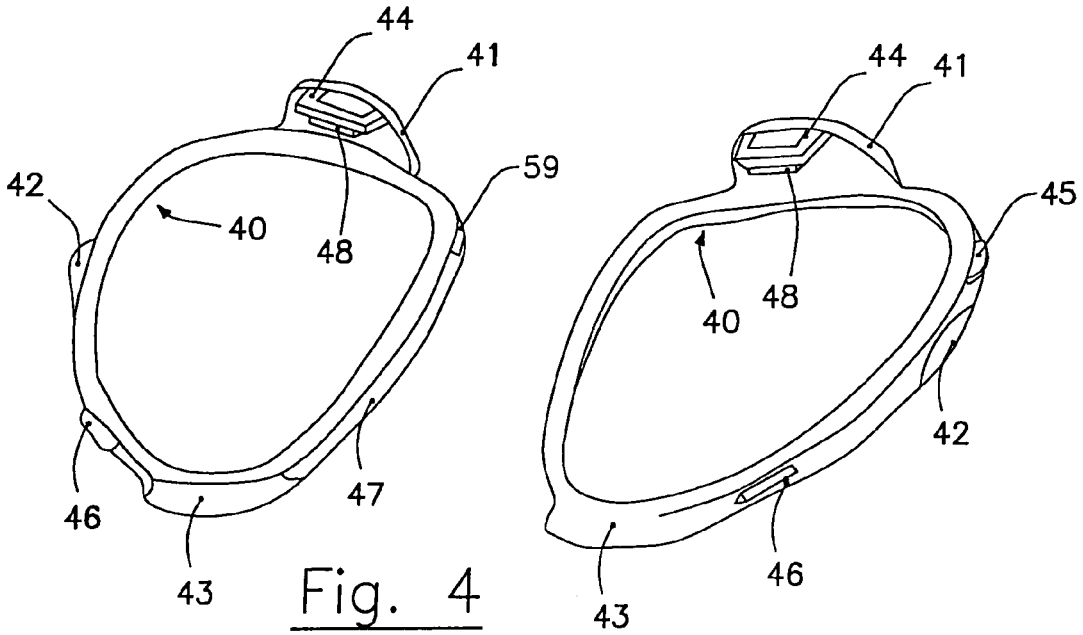
FIG. 4 is a rear perspective view of the lens-retaining collars shown in FIG. 3.
Figure 5:
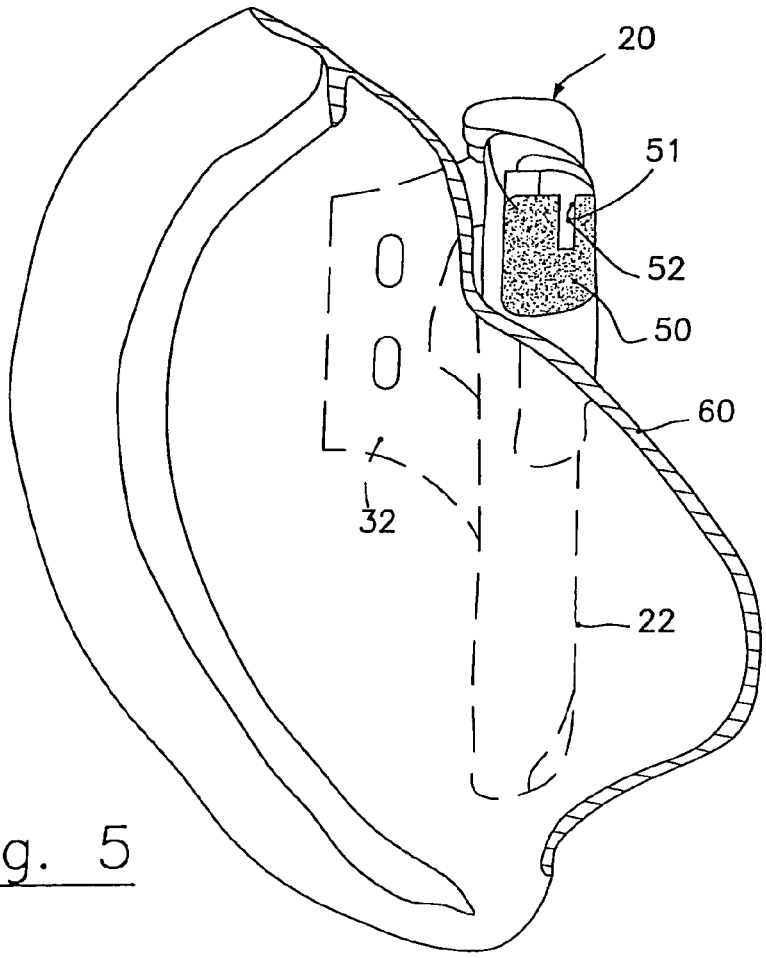
FIG. 5 is a sectional view of the mask taken along lines V-V of FIG. 1.
Figure 6:
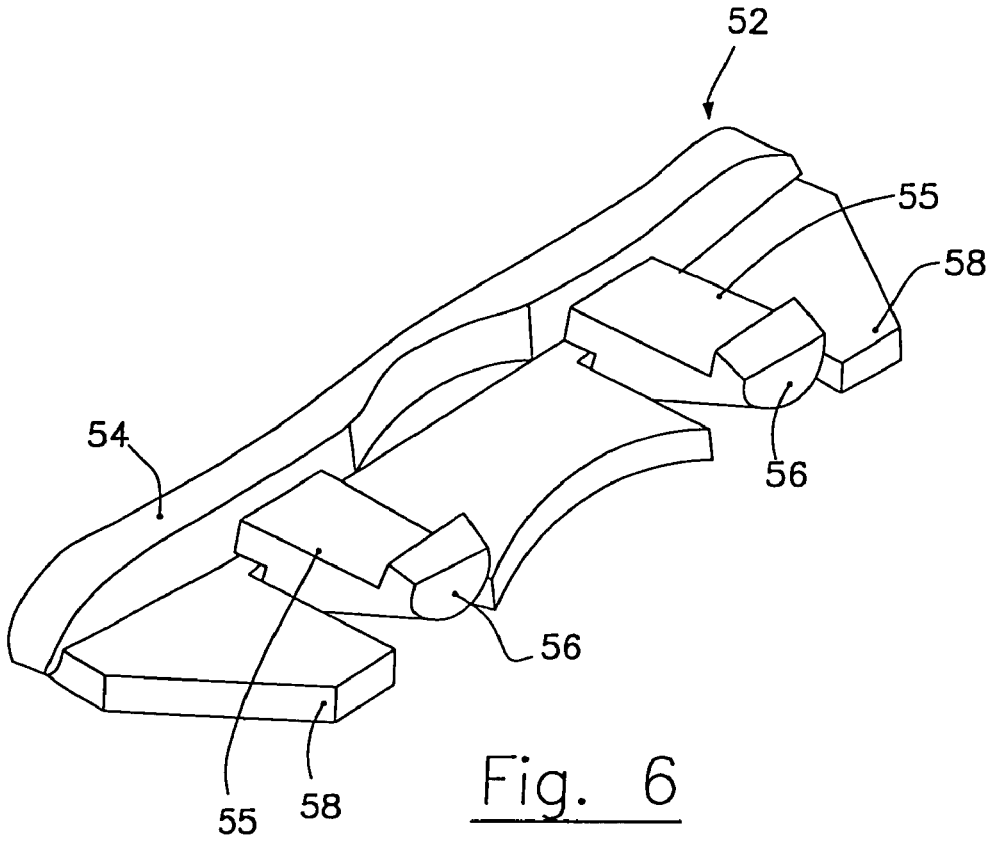
FIG. 6 is a front perspective view of the mask illustrated in FIG. 1 showing a sliding element in a bridge of the mask.
Figure 7:
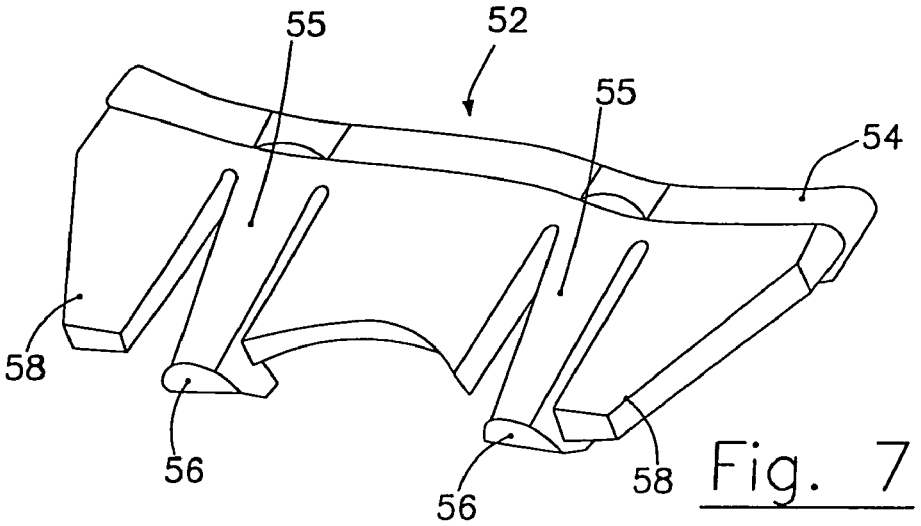
FIG. 7 is a rear perspective view of the sliding element illustrated in FIG. 6.

Similarly, as illustrated in FIGS. 3, 3*c* and 5, collar 40 has a corresponding notch 59 configured suitably for receiving a lateral side 58 of locking plate 52 when in its lower end position, thereby locking the collar inside ring 22. The upper and lower end stroke positions define, respectively, a release end position and a locking end position for the locking plate relative to the collar-ring fitting. The locking plate is best seen in FIGS. 6 and 7.

To clearly define its lowermost working position, locking plate 52 has an upper flange 54 that rests against an upper border of bridge 50 so as to prevent its further downward movement.

Figure 1D:
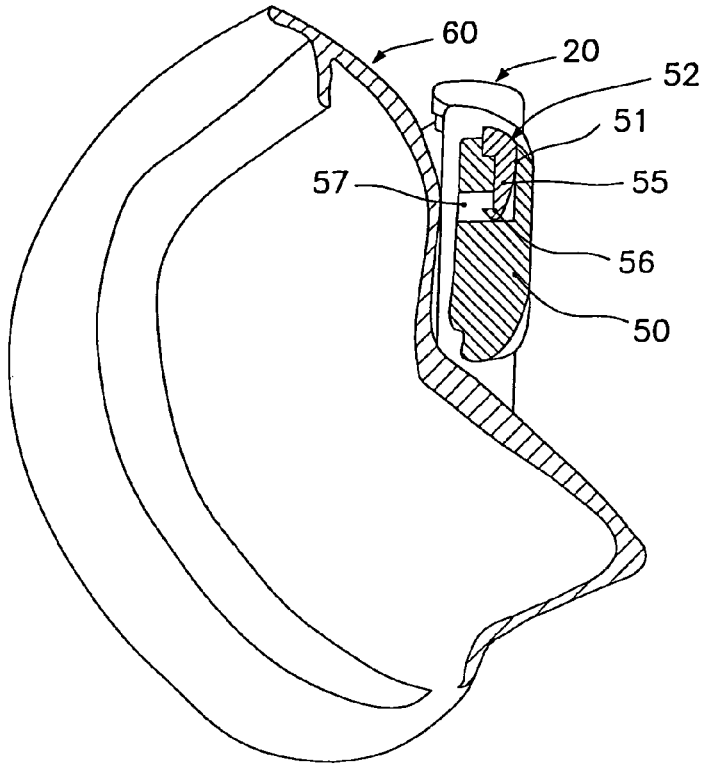

To define its uppermost position and prevent its complete extraction, the locking plate has a projection 56, on an opposite side of flange 54, slidingly engaged in and with an elongated opening 57 formed in the bridge. More particularly, as shown in FIGS. 1*d*, 6 and 7, the projection includes a plurality of feet 56, e.g., a pair, extending from respective legs 55 of the locking plate. Feet 56 are desirably engaged with the opening, the length of which defines a stroke of locking plate 52 slot 51.

Turning now to assembly of the mask, initially lip 61 of skirt 60 is inserted in rings 22 so as to abut their respective internal flanges 23. Next, lens 30 is placed on the lip and collar 40 is mounted on the lens. The collar is pressed slightly in a selected lateral direction, and inserted in openings 21 that teeth 45, 46 and 47 engage with or fit into cavities 28. Finally, the upper part of the collar is pressed such that tooth 44 on upper flange 41 snaps into a rear surface of ring 22, and rib 48 engages or slides into groove 29.

To prevent detachment of the the collars from frame 20, such as upon accidental impact, locking plate 52 may be lowered from the release end position to the locking end position, causing lower lateral sides 58 of the plate to engage or fit into notches 59 (formed in the thickness of the collars) which pass through slits 53 in rings 22. In this manner, the mask structure is secured or otherwise stabilized in its assembled position.

To disassemble the mask, e.g., to replace a lens, the locking plate is first raised by pulling flange 54. A selected force is then applied to upper flange 41 so as to cause tooth 44 to disengage from the back portion of ring 22, and rib 48 from groove 29. The steps of mask assembly are then repeated in reverse order until the lens requiring replacement can be removed.

Various modifications and alterations to the present invention may be appreciated based on a review of this disclosure. These changes and additions are intended to be within the scope and spirit of the invention as defined in by the following claims.

The invention claimed is:

1. A scuba diving mask with corrective lenses comprising a frame with a plurality of rings joined to one another by a bridge, each of the rings having an internal flange on which a lip of a flexible skirt, a corresponding lens, and a lens-retaining collar rest, the collar being attached by snap action to the corresponding ring, wherein a seat is formed in the bridge substantially in the lying plane of the lenses and extending laterally to the upper internal portion of the rings, the seat including a locking plate slidable between opposing end stroke positions - a locking end position and a release end position, respectively, - such that when the locking plate is in the locking position, the lateral sides of the locking plate extend inside the rings and are engaged with corresponding notches in an upper internal rim of the lens-retaining collars.

2. The mask set forth in claim 1, wherein the seat includes a slot formed in the bridge.

3. The mask set forth in claim 1, wherein the locking plate has an upper flange that limits its downward displacement and enables it to be grasped and lifted.

4. The mask set forth in claim 1, wherein the locking plate has at least one projection suitable for slidingly engaging with a corresponding opening on the inner surface of the seat, the length of the opening defining the end stroke positions of the locking plate.

5. The mask set forth in claim 4, wherein the projection is formed by a plurality of feet projecting from respective legs of the locking plate and slidingly engaging with the locking plate and with the openings formed correspondingly in a wall of the seat.

6. The mask set forth in claim 1, wherein each lens-retaining collar has one or more ribs on an outer lateral surface suitable for engaging with corresponding grooves formed on the inner surface of the rings of the frame.

7. The mask set forth in claim 6, wherein the lens-retaining collar has several flanges, one of which has a rim ending with a tooth that engages with a corresponding groove on the rear of the ring.

8. The mask set forth in claim 1, wherein each lens-retaining collar has at least one flange that surrounds an outer contour of the corresponding ring.

9. The mask set forth in claim 8, wherein the at least one flange is inserted in a corresponding housing formed in a front surface of the rings.

* * * * *